US005410112A

United States Patent [19]

Freeman

[11] Patent Number: 5,410,112

[45] Date of Patent: Apr. 25, 1995

[54] SAFETY INTERLOCK FOR OVERHEAD PROJECTOR

[75] Inventor: David S. Freeman, Austin, Tex.

[73] Assignee: Minnesota Mining and Manufacturing Company, Del.

[21] Appl. No.: 193,269

[22] Filed: Feb. 8, 1994

[51] Int. Cl.[6] ..... H01H 9/22

[52] U.S. Cl. ..... 200/50 A; 200/574; 200/333; 361/616

[58] Field of Search ..... 361/605, 607, 610, 615, 361/616, 673, 807, 809, 837; 200/50 R, 50 A, 61.58 R, 61.62, 61.7, 518, 553, 558, 568, 573, 574, 293, 321, 322, 324, 330, 332, 333

[56] References Cited

U.S. PATENT DOCUMENTS

| | | | |
|---|---|---|---|
| Re. 34,396 | 10/1993 | Wollenhaupt | 200/50 R |
| 3,632,917 | 1/1972 | Norden | 200/50 A |
| 4,806,710 | 2/1989 | Kalvaitis | 200/50 A |
| 4,885,436 | 12/1989 | Pham | 200/50 A |

*Primary Examiner*—Gerald P. Tolin

*Attorney, Agent, or Firm*—Gary L. Griswold; Walter N. Kirn; David W. Anderson

[57] ABSTRACT

A safety interlock for an overhead projector utilizes only one electrical switch to provide the functions of both a conventional power switch and a safety interlock switch. In an operational mode, the switch responds to a cam surface for actuation. In a safety interlock mode, the switch is allowed to rotate in response to forces generated by the cam surface rather than being actuated.

5 Claims, 2 Drawing Sheets

SAFETY INTERLOCK FOR OVERHEAD PROJECTOR

FIELD OF THE INVENTION

The present invention relates generally to safety interlock mechanisms for electrically powered devices, and more particularly to such mechanisms for overhead projectors.

BACKGROUND OF THE INVENTION

Electrically powered appliances usually require safety interlock mechanisms to protect people from electrical shock in the event the housing of the appliance is opened while the appliance is plugged in. Such interlock mechanisms in the past have typically included a safety electrical switch in series with the power switch for the appliance, with the interlock switch situated in such a fashion that the switch was actuated to open the electrical circuit when the appliance housing was opened. This arrangement resulted in added expense since separate power and safety switches were required. It would be desirable to combine the functions of the power and safety switches into one switch and so reduce the cost of manufacture of the appliance.

SUMMARY OF THE INVENTION

The goal of combining the functions of a power switch and a safety switch is accomplished according to the present invention by providing an interlock mechanism for an electrically-powered overhead projector including a housing having a cover moveable between an open position and a closed position, the interlock mechanism comprising an electrical switch including a mounting hole, contacts for connecting electrical power to the device at an on position and for disconnecting electrical power from the device at an off position, a switch body, and an actuator extending from the switch body and connected to the contacts for moving the contacts between the on position and the off position, a mechanical fastener pivotally mounting the switch body by means of the mounting hole to the housing such that rotational movement of the switch body is permitted between an operational position and a safety position, a projection attached to the cover for contacting and maintaining the switch body in the operational position when the cover is in the closed position and for permitting movement of the switch body to the safety position when the cover is in the open position, a cam surface rotatably mounted on the housing and contacting the actuator for moving the actuator between the off position and the on position when the switch body is in the operational position, wherein movement of the cover to the open position will allow the switch body to pivot to the safety position in response to force on the actuator and so prevent the actuator from moving the contacts to the on position and thereby prevent the contacts from connecting electrical power to the device when the cover is in the open position.

BRIEF DESCRIPTION OF THE DRAWINGS

The present invention will be more thoroughly described with respect to the accompanying drawings, wherein like numbers refer to like parts in the several views, and wherein.

DESCRIPTION OF THE PREFERRED EMBODIMENT

Figure 1:
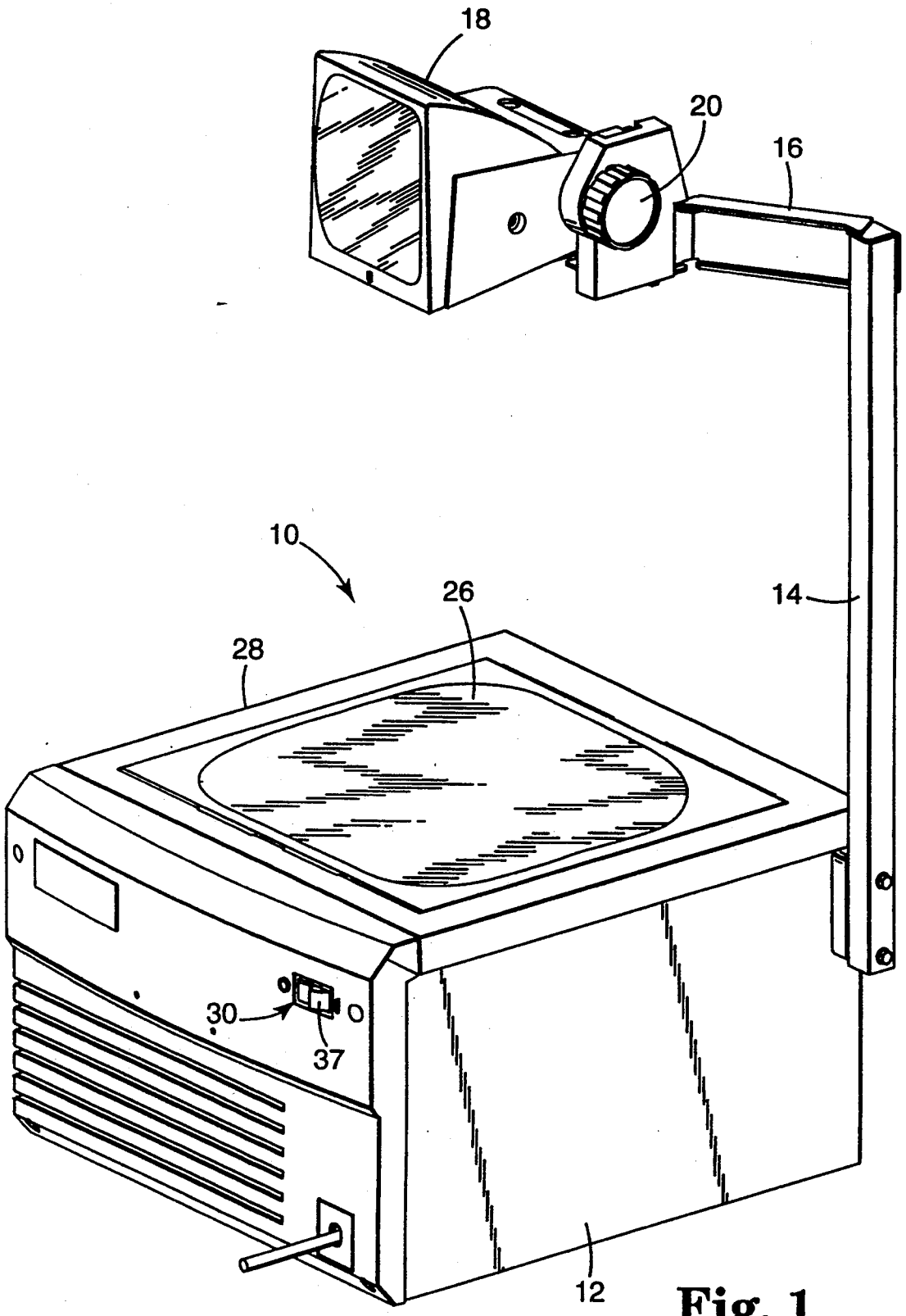
FIG. 1 is a perspective view of an overhead projector including the present invention.

FIG. 1 illustrates an overhead projector, generally indicated as 10, which includes a housing 12, a support post 14, and a projection head arm 16 extending from the support post 14 to support a projection head 18. A height adjustment mechanism 20 is located between the projection head arm 16 and the projection head 18 to facilitate focussing of a projected image. The housing 12 of the projector 10 includes a light source (not shown) which directs light to the projection head 18 where it is collected by a projection lens and redirected to a projection surface. In this way an image of a transparency placed on a stage 26 of the projector 10 may be magnified and projected at a distance for viewing by a group. The projector has means which allow the stage 26 and the top surface, or cover 28 of the housing 12 to be slid toward the rear to open the housing 12.

The light source for the projector is powered by electricity obtained from a building source, and the light source is actuated by a lamp activation mechanism 30 located at the front of the projector 10. If the cover 28 were opened while the projector 10 were plugged in, the operator could be exposed to potentially lethal electrical power located at many points within the housing 12. It is necessary, therefore, to provide the projector 10 with a safety interlock which will disconnect the electrical power supplied to the projector 10 when the cover 28 is open.

Figure 2:
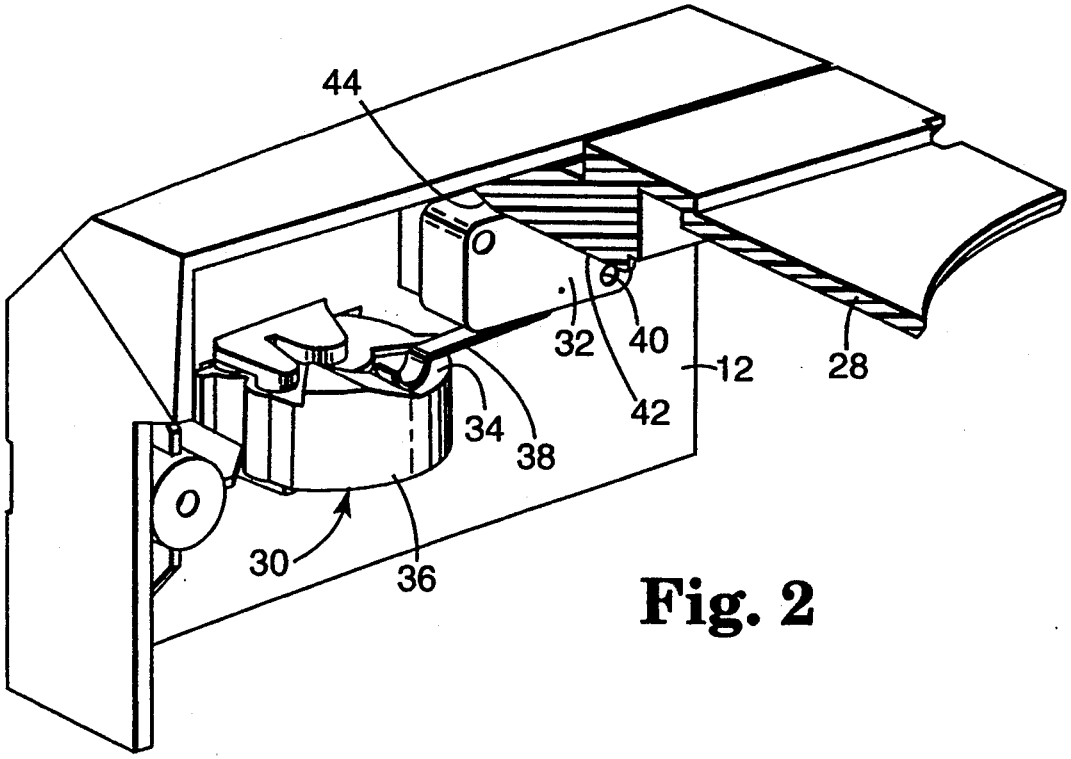
FIG. 2 is a perspective view from the interior of the overhead projector of FIG. 1 illustrating a portion of the overhead projector and a cover for the projector in cross-section.

With reference to FIG. 2, the functions of a power switch and a safety interlock switch are combined in a single electrical switch 32 located within the housing 12 adjacent the lamp activation mechanism 30. The lamp activation mechanism 30 is not an electrical switch, but rather is simply a mechanism comprising a cam surface 34 formed on the top surface of a rotating member 36. The rotating member 36 has a portion 37 which projects through the housing 12 to allow the operator to rotate the member 36 from outside the housing 12.

The interlock switch 32 has internal contacts (not shown) which connect and disconnect electrical power available to the overhead projector 10 from the building source. The switch 32 will be connected to electrical wires (not shown) which will distribute power to the elements within the housing 12 requiring electricity. The position of the contacts of the switch 32 are determined by the position of an actuating lever 38. The position of the actuating lever 38 is determined by the position of the cam surface 34.

Thus far, the mechanism described is conventional in nature in the sense that a simple on/off mechanism has been described wherein the operator manipulates a mechanism 30 at the front of the housing 12 to cause movement of the interlock actuating lever 38 and operation of the switch 32. Movement of the actuating lever 38 upward, as viewed in FIG. 2, connects the contacts within the switch 32 and allows power to flow to the projector 10, while movement of the actuating lever 38 downward disrupts the flow of electricity to the projector 10.

What transforms the above-described mechanism into an interlock mechanism are the mounting of the switch 32 and interaction between the switch and the cover 28. The switch is mounted to the housing 12 at a hole 40. Mounting is accomplished by means of a mechanical fastener (not shown) extending through the hole 40 to engage the housing 12. The hole 40 and the fastener, which may be such things as a screw, bolt, rivet or simply a post with a suitable retainer, are sized to allow the switch 32 to pivot on the fastener. The cover 28 is provided with a projection 42 that extends under a portion of the front of the housing to contact the switch 32 and prevent rotation of the switch 32 around the fastener. Thus when the cover 28 is closed, the switch 32 is maintained in place as illustrated in FIG. 2 and operates in response to rotation of the lamp actuation mechanism 30 and the cam surface 34 to connect and disconnect power to the projector 10.

However, when the cover 28 is opened by sliding the cover 28 away from the switch 32, the projection 42 of the cover 28 is removed from contact with the switch 32 and the switch 32 is free to rotate with respect the housing 12. Thus upward movement of the actuating lever 38 in response to movement of the cam 34 will result in rotation of the switch 32 rather than movement of the actuating lever 38 relative to the switch 32. As a result, the contacts within the switch 32 will not be closed and electricity will not flow through the switch 32.

When the cover 28 is once again closed, a sloped surface 44 of the projection will force the switch 32 downward to the position illustrated, and proper positioning of the cam surface 34 will once again actuate the switch 32.

Thus there has been described an safety interlock mechanism which utilizes only one electrical switch 32 and so is more economical than prior mechanisms which require a greater number of switches. Many modifications of the described device will be apparent to those skilled in the art. For example, the switch 32 need not be actuated by a lever 38. A button or other projection could interact with the cam surface 34. The location of the hole 40 in the switch body 32 need not be as illustrated. All that is required is that the switch 32 be allowed to rotate. An external spring acting on the switch body 32 could be provided to ensure that the switch 32 will rotate and the actuating lever 38 will not be engaged by the cam 34 when the cover 28 is open. And finally, the safety interlock mechanism is not limited to an overhead projector. Any electrical device having a similar housing could benefit from the present invention.

I claim:

1. An interlock mechanism for an electrically-powered device including a housing having a portion movable between an open position and a closed position, the interlock mechanism comprising:

a electrical switch including contact means for connecting electrical power to the device at an on position and for disconnecting electrical power from the device at an off position, a switch body, and an actuation means extending from said switch body and connected to said contact means for moving said contact means between said on position and said off position;

means for pivotally mounting said switch body to the housing such that movement of said switch body is permitted between an operational position and a safety position;

means attached to the moveable housing portion for maintaining said switch body in said operational position when said moveable housing portion is in said closed position and for permitting movement of said switch body to said safety position when said moveable housing portion is in said open position;

means attached to the device housing for moving said actuation means between said off position and said on position when said switch body is in said operational position;

wherein movement of the moveable housing portion to said open position will allow said switch body to pivot to said safety position in response to force on said actuation means and so prevent said actuation means from moving said contact means to said on position and thereby prevent said contact means from connecting electrical power to the device when said moveable housing portion is in said open position.

2. An interlock mechanism according to claim 1 wherein said means attached to said moveable housing portion is a projection which contacts said switch body when said moveable housing portion is in said closed position.

3. An interlock mechanism according to claim 1 wherein said actuation means is a lever extending from said switch body and said means for moving said actuation means is a cam surface mounted on and rotatable with respect to said housing which engages said lever.

4. An interlock mechanism according to claim 1 wherein said means for pivotally mounting said switch body is a hole through said switch body and a fastener extending through said hole and attached to said housing.

5. An interlock mechanism for an electrically-powered device including a housing having a cover moveable between an open position and a closed position, the interlock mechanism comprising:

a electrical switch including contacts for connecting electrical power to the device at an on position and for disconnecting electrical power from the device at an off position, a switch body including a mounting hole, and an actuator extending from said switch body and connected to said contacts for moving said contacts between said on position and said off position;

a mechanical fastener pivotally mounting said switch body by means of said mounting hole to the housing such that movement of said switch body is permitted between an operational position and a safety position;

a projection attached to the cover for contacting and maintaining said switch body in said operational position when said cover is in said closed position and for permitting movement of said switch body to said safety position when said cover is in said open position;

a cam surface rotatably mounted on the housing and contacting said actuator for moving said actuator between said off position and said on position when said switch body is in said operational position;

wherein movement of the cover to said open position will allow said switch body to pivot to said safety position in response to force on said actuator and so prevent said actuator from moving said contacts to said on position and thereby prevent said contacts from connecting electrical power to the device when said cover is in said open position.

* * * * *